US010894440B2

(12) United States Patent
Danko

(10) Patent No.: US 10,894,440 B2
(45) Date of Patent: Jan. 19, 2021

(54) WRITING INSTRUMENT FOR CARPENTRY

(71) Applicant: Handy Scribe, LLC, Cheshire, CT (US)

(72) Inventor: John Danko, Southington, CT (US)

(73) Assignee: Handy Scribe, LLC, Cheshire, CT (US)

( * ) Notice: Subject to any disclaimer, the term of this patent is extended or adjusted under 35 U.S.C. 154(b) by 28 days.

(21) Appl. No.: 16/251,842

(22) Filed: Jan. 18, 2019

(65) Prior Publication Data

US 2019/0217655 A1 Jul. 18, 2019

Related U.S. Application Data

(60) Provisional application No. 62/618,930, filed on Jan. 18, 2018.

(51) Int. Cl.
*B43K 19/00* (2006.01)
*B43K 19/02* (2006.01)

(52) U.S. Cl.
CPC ..... *B43K 19/02* (2013.01)

(58) Field of Classification Search
CPC ..... B43K 19/02; B43K 19/12
See application file for complete search history.

(56) References Cited

U.S. PATENT DOCUMENTS

D126,555 S * 4/1941 Gurtov ..... D8/62
3,352,621 A * 11/1967 Fehling ..... B43K 24/02 401/109
D299,660 S * 1/1989 Gordo ..... D19/200
RE38,440 E * 2/2004 Dowst ..... B43K 7/00 401/207
2004/0175223 A1* 9/2004 Berry ..... A45D 40/20 401/96

* cited by examiner

*Primary Examiner* — Jennifer C Chiang
(74) *Attorney, Agent, or Firm* — Alix, Yale & Ristas, LLP

(57) ABSTRACT

A writing instrument for primary use within carpentry a body that extends from a distal end to a proximal end having a marking tip. The body has a substantially round cross-sectional shape and the marking tip is offset from a center of the cross-sectional shape. The round shape can non-uniform, such as ovular or egg-shaped with the marking tip offset from the center of at least the length or the width thereof. The offset positioning of the marking tip relative to the outer surface of the body provides clearance to scribe a building material.

20 Claims, 10 Drawing Sheets

PRIOR ART Figure 2

WRITING INSTRUMENT FOR CARPENTRY

CROSS-REFERENCE TO RELATED APPLICATION

This application claims priority from U.S. Provisional Patent Application No. 62/618,930 filed Jan. 18, 2018, the entire content of which is incorporated herein by reference.

BACKGROUND

The disclosed embodiments relate to a writing instrument, and more particularly, a writing instrument or pencil for use primarily in carpentry, for example, to scribe uneven contours on surfaces.

Tools and methods exist in the carpentry field for marking (or "scribing") a board or similar building material to substantially correspond to the contour of an uneven surface on another building material, such as a wall. FIGS. 1 and 2 show two illustrations of scribing techniques using a compass or similar tool. As shown, a user typically opens a compass and aligns the leg without the pencil against the surface of the first building material (wall) with the pencil positioned to mark the second building material with a "cut" line. The user then runs the compass along the uneven surface of the first building material to scribe the second building material with a matching pencil line that substantially matches the contour of the uneven surface. The second building material can then be cut along the line to yield an edge that substantially corresponds to the uneven contour of the surface.

In the prior art methods described above and illustrated generally in FIGS. 1 and 2, a compass or similar expanding tool is necessary to accommodate uneven surfaces with pitches of varying depths. These methods and tools are necessarily cumbersome for the user to set up and adjust, thereby inviting difficulties and inconsistent results.

It would be useful to have a standalone writing instrument for scribing building materials to correspond with uneven surfaces that eliminates the above-noted drawbacks, for example, a pencil.

SUMMARY

Disclosed herein is an embodiment of a writing instrument having an elongate body extending in an axial direction from a proximal end to a distal end. The body has a cross-sectional shape, with the cross-sectional shape defining a length L in a first direction and a width W in a second direction perpendicular to the first direction. The distal end includes a marking tip at a position offset from a center point of at least one of the length L and the width W.

In another embodiment, a writing instrument comprises an elongate body extending in an axial direction from a proximal end to a distal end. The body has a non-uniform cross-section in a direction perpendicular to the axial direction. The cross-section has a width W and a length L. A marking tip is positioned at the distal end of the body in a position offset from a midpoint along at least one of the width W and length L.

In yet another embodiment, a writing instrument comprises an elongate body extending in an axial direction from a proximal end to a distal end. The body has a substantially ovular cross-sectional shape. A marking tip is positioned at the distal end of the body at a position offset from a center of the ovular cross-sectional shape.

BRIEF DESCRIPTION OF THE DRAWINGS

Preferred embodiments of the disclosed writing instrument are described herein with reference to the accompanying drawings, wherein like numerals represent like elements throughout, in which.

DISCLOSURE OF THE INVENTION

Figure 1:
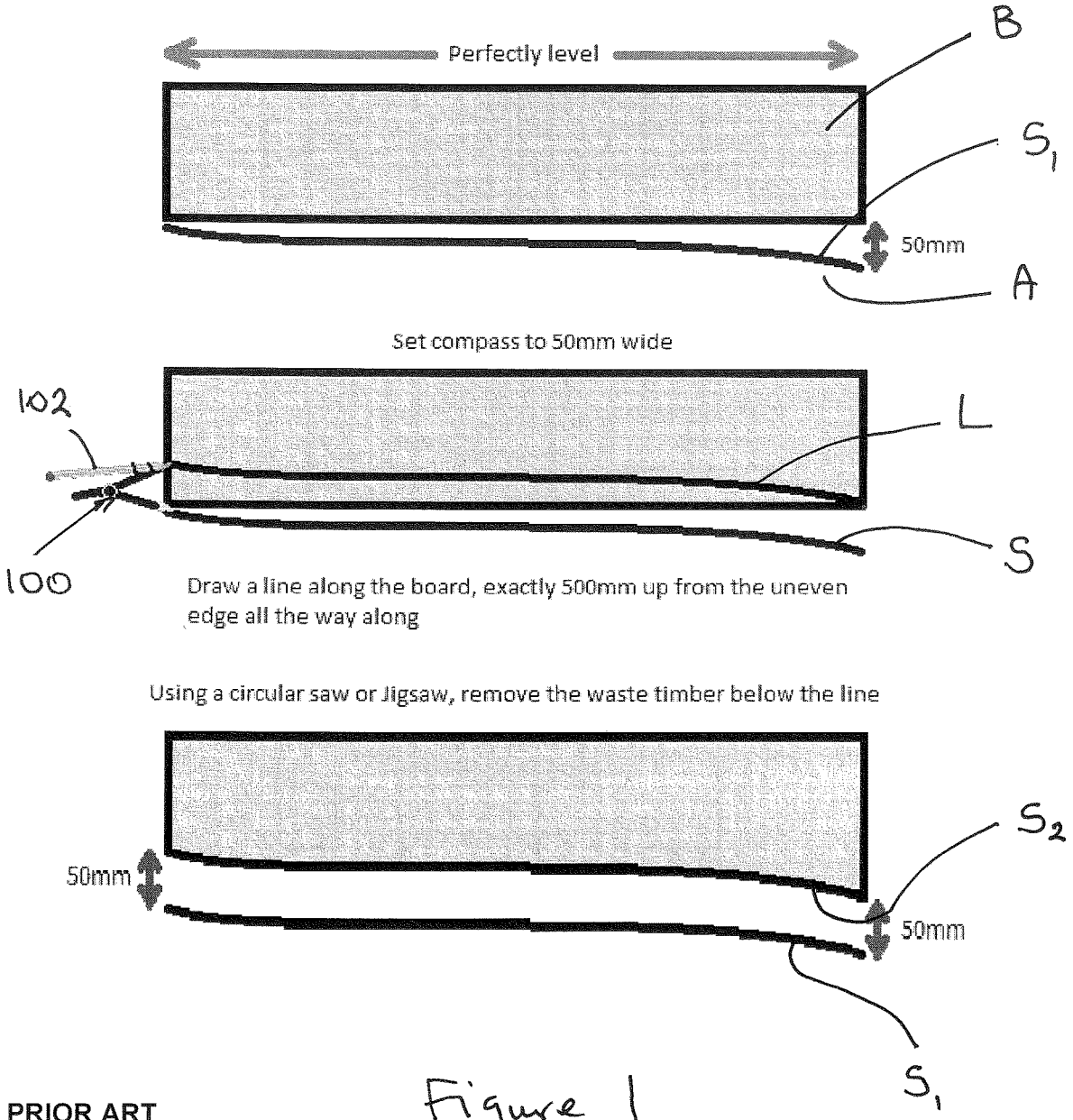
PRIOR ART Figure 1
FIGS. 1-2 depict prior art methods of scribing building materials.
Figure 2:
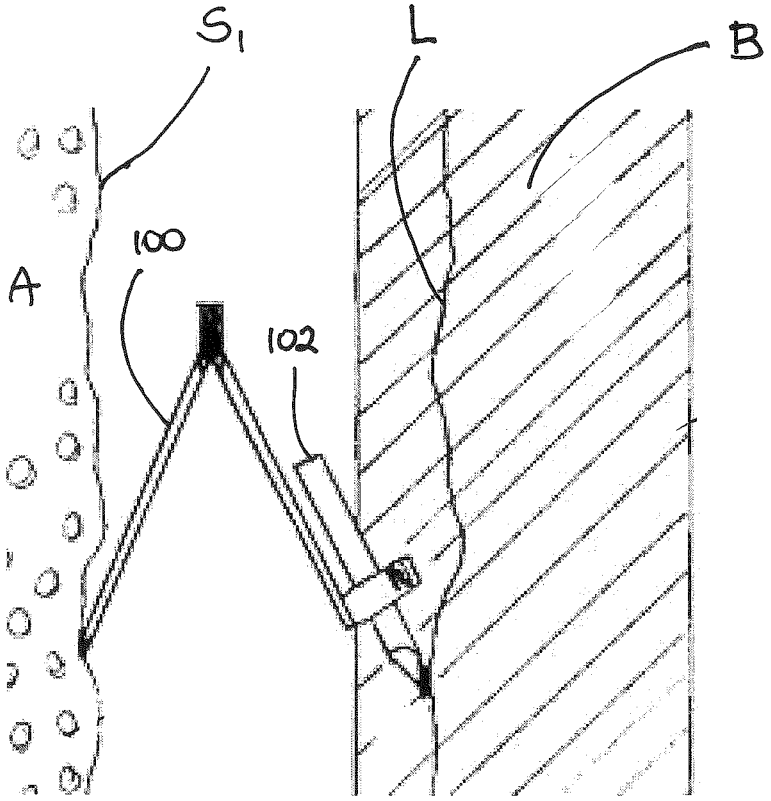
Figure 3:
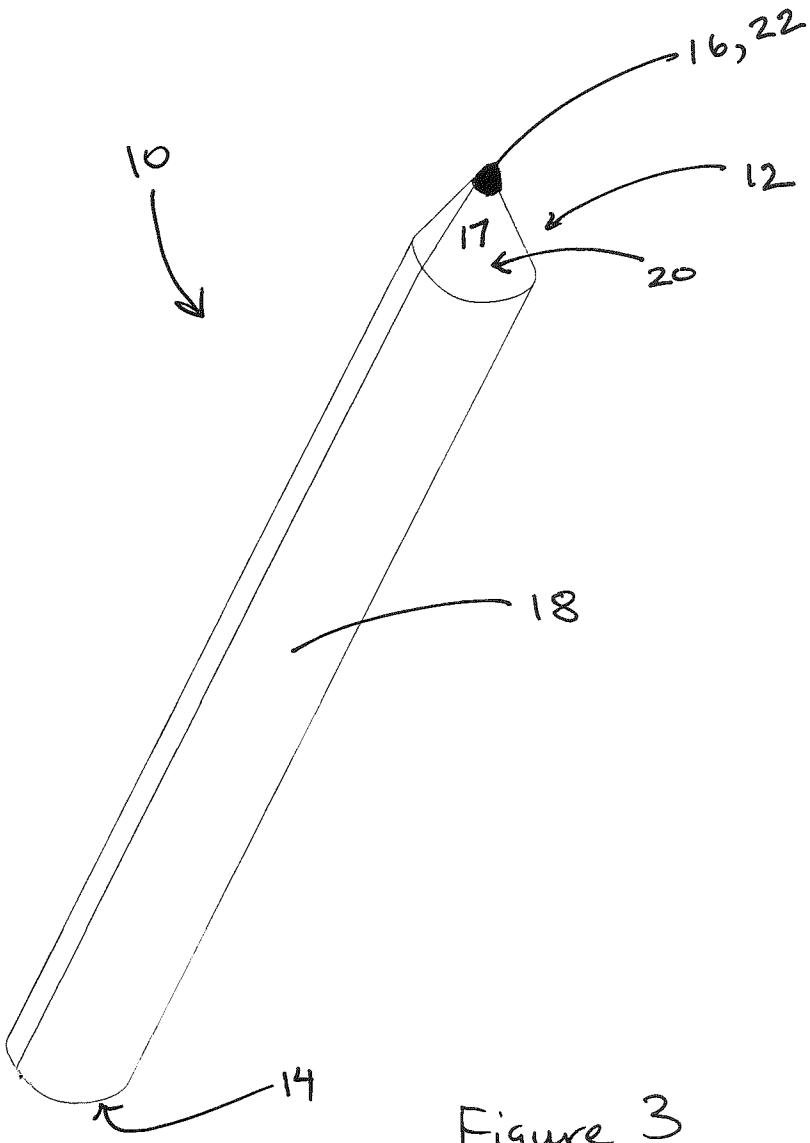
FIG. 3 is a distal perspective view of an embodiment of the disclosed writing instrument.
Figure 4:
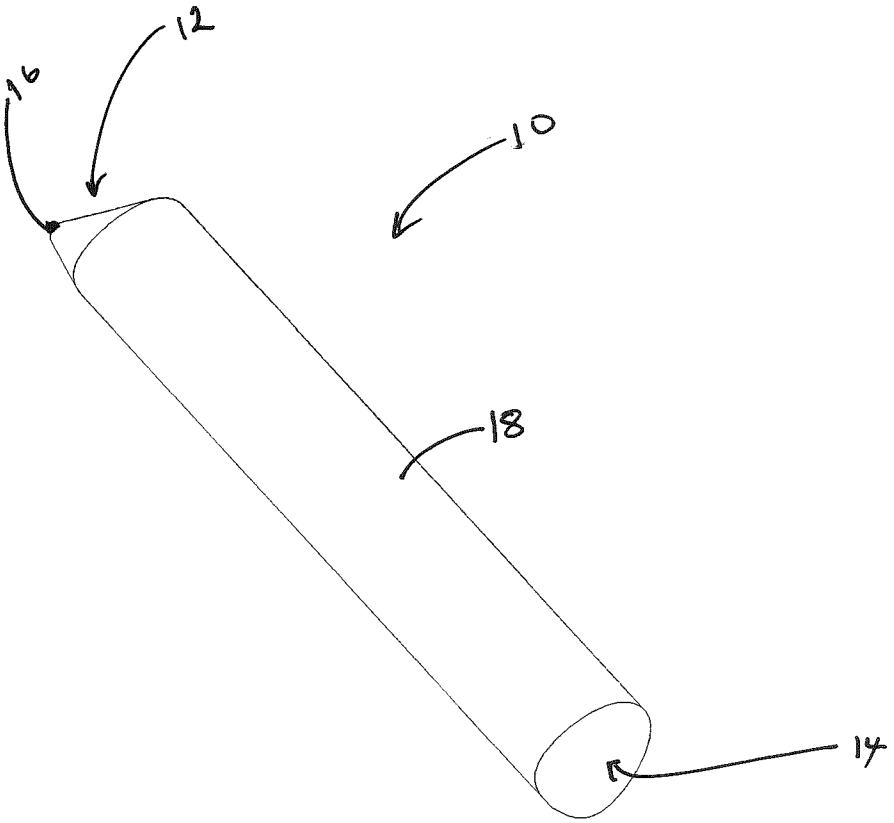
FIG. 4 is a proximal perspective view of the disclosed writing instrument.
Figure 5:
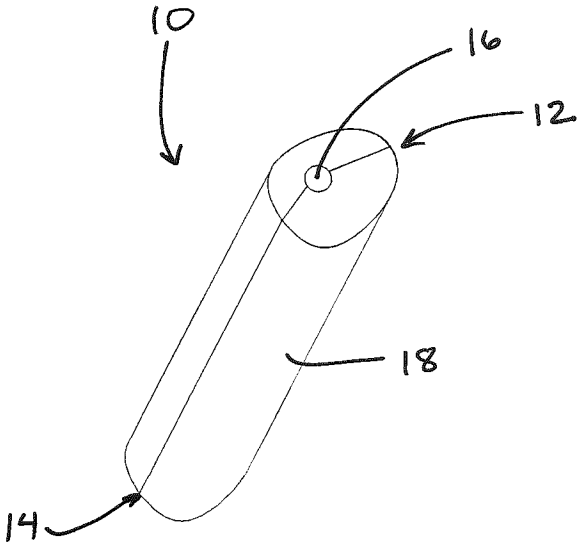
FIG. 5 is another distal perspective view of the disclosed writing instrument.

Among the benefits and improvements disclosed herein, other objects and advantages of the disclosed embodiments will become apparent from the following wherein like numerals represent like parts throughout the several figures. Detailed embodiments of a writing instrument for use in carpentry are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined With reference to the drawings, disclosed herein is a carpentry pencil 10 extending from a proximal butt end 14 to a distal point end 12. The pencil 10 includes an elongate rod of graphite 16 circumscribed by an inert support section 17, which is most commonly made from wood. Like common pencils, the carpentry pencil 10 includes an elongate body 18 with an outer circumferential wall that extends from the proximal end 14 to an offset conical distal portion 20 that terminates at a marking tip 22. In a preferred non-limiting embodiment, the writing instrument 10 is a pencil with an elongate graphite rod 16 forming the marking tip. Other embodiments exist, such as a pen version with a tip 22 for marking with ink.

Figure 7:
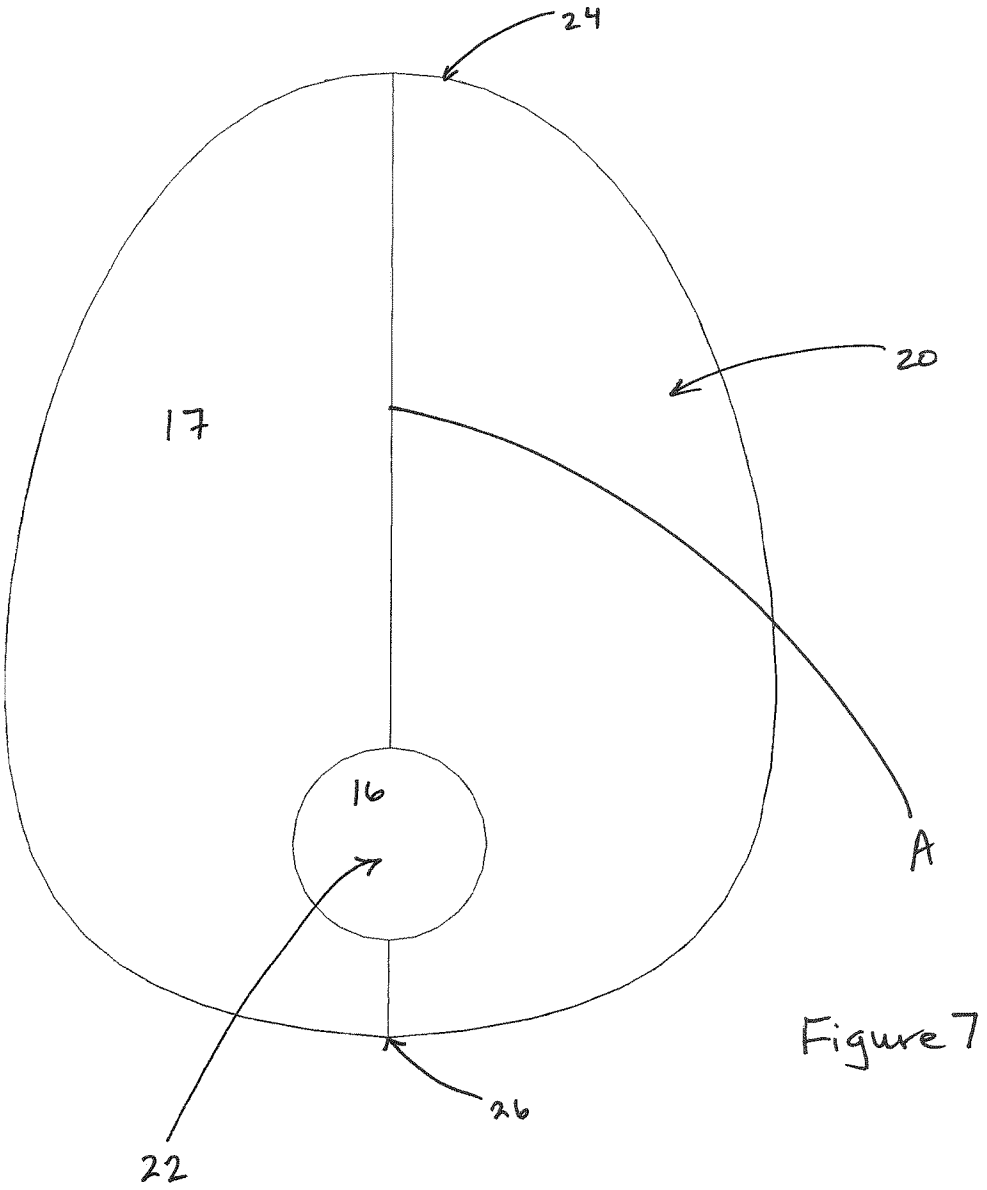
FIG. 7 is an elevation view of the distal point end of the disclosed writing instrument.

As shown in the Figures, rather than circular cross section common to pencils and other writing instruments, the carpentry pencil 10 has a cross section that is an offset oval that can also be referred to as egg-shaped. In other words, the cross-section of the pencil 10 is an oval with only one axis of symmetry generally shown as axis A in FIG. 7. As shown, axis A extends from a narrow portion of the pencil, shown as reference numeral 24, to a wide portion 26 to split the pencil into two substantially identical halves. In the depicted preferred embodiment, the graphite rod 16 or ink tip is located along the central axis A in the wide portion 26.

Figure 8:
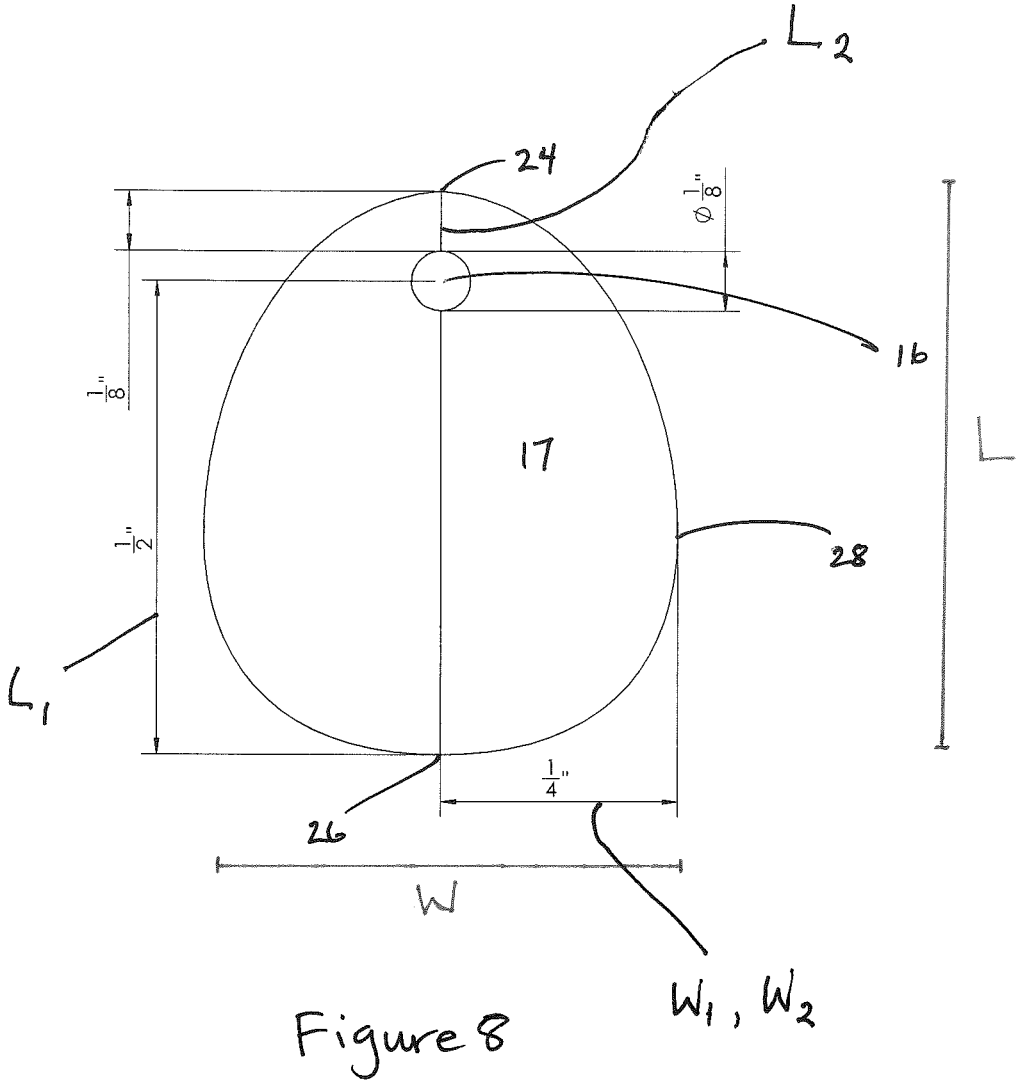
FIG. 8 is an elevation view of the distal end of the writing instrument with preferred dimensions.

FIG. 8 shows cross-sectional dimensions of a preferred embodiment of the carpentry pencil 10, specifically:

Length from outer circumferential edge of wide portion 26 to graphite rod 16 ($L_1$): approximately 0.5 inches.

Width of central axis A to outermost circumferential edges 28 ($W_1$, $W_2$): approximately 0.25 inches.

Diameter of graphite rod 16: approximately 0.125 inches.

Length outer circumferential edge of narrow portion 24 to graphite rod 16 ($L_2$): approximately 0.125 inches.

Figure 9:
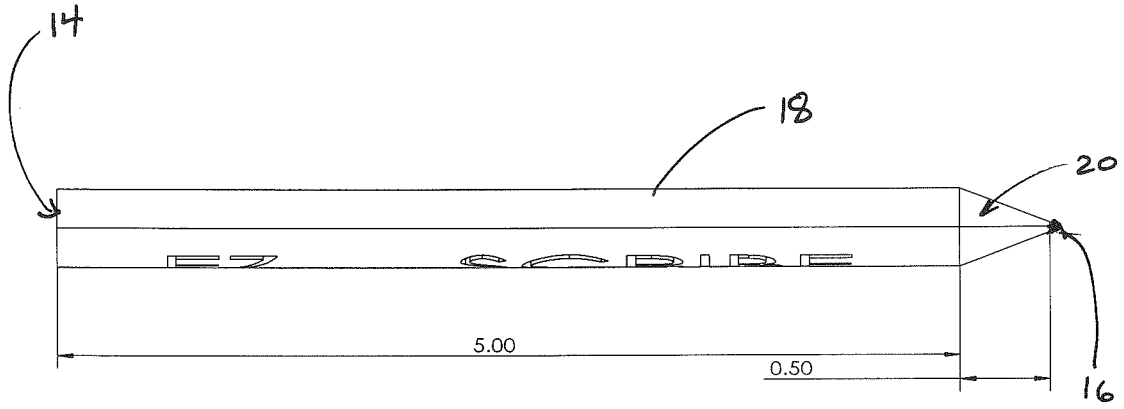
FIG. 9 shows preferred dimensions of the axial length of an embodiment of the writing instrument.

FIG. 9 shows length dimensions of the preferred embodiment of the pencil 10. While preferred dimensions are described above and shown in FIGS. 8 and 9, these are for illustrative purposes only with reference to a specific preferred embodiment of the pencil 10, and thus non-limiting to the inventive aspects of the pencil.

Notably, the embodiment depicted in the Figures is a preferred, non-limiting embodiment of the writing instrument 10. Other embodiments exist with variations in dimensions and shape. For example, the body may be circular, symmetrical ovular or polygonal with an offset marking tip 22 that provides a variety of clearance distances between the outer body surfaces and the tip 22.

Figure 6:
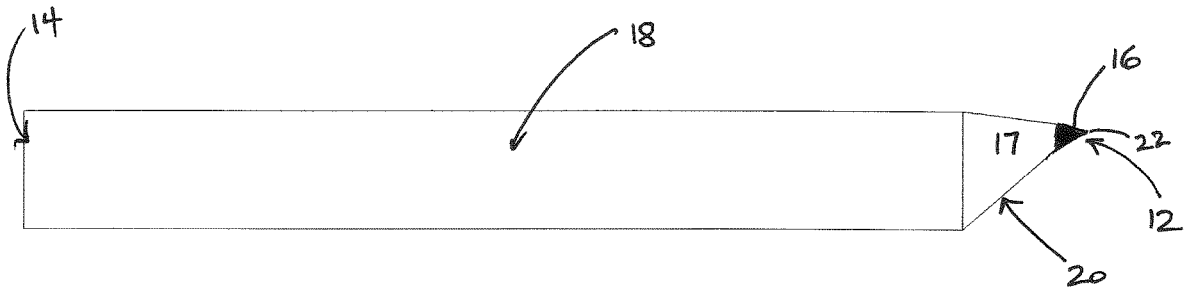
FIG. 6 is a side elevation view of the disclosed writing instrument.

As shown most clearly in the side view of FIG. 6, the uneven ovular or egg-shaped cross section yields an offset conical distal portion 20 when sharpened like a common pencil. The uneven conical distal portion 20 with egg-shaped cross section allows any uneven surface from approximately 0.0625-0.5 inch discrepancies and depths without needing a compass or any other specialty tool.

In a typical operation, a second building material $B_2$ can be maintained in a perpendicular arrangement against the surface of the first building material. The writing instrument 10 is then positioned flat against the surface of the first building material $B_1$ with the marking tip 22 in position against the second building material $B_2$ for marking. The user can then run the instrument 10 along the surface of the first building material $B_1$ while maintaining the outer edge of the body 18 flat to mark the second building material with a line that corresponds closely to the contour of the first building material surface.

The offset positioning of the marking tip 22 or graphite rod 16 within the writing instrument 10 provides the requisite clearance to scribe the surface without requiring a separate tool, like a compass. Moreover, the egg-shaped cross-sectional shape (and outer surface) of the body 18 provides versatility to accommodate a wide range of uneven surfaces. In this way, a user can pivot the pencil to any point around the entire circumference of the outer surface, which shifts the marking tip 22 closer or further from the surface of the building material (i.e., less or greater clearance from the surface).

Figure 10A:
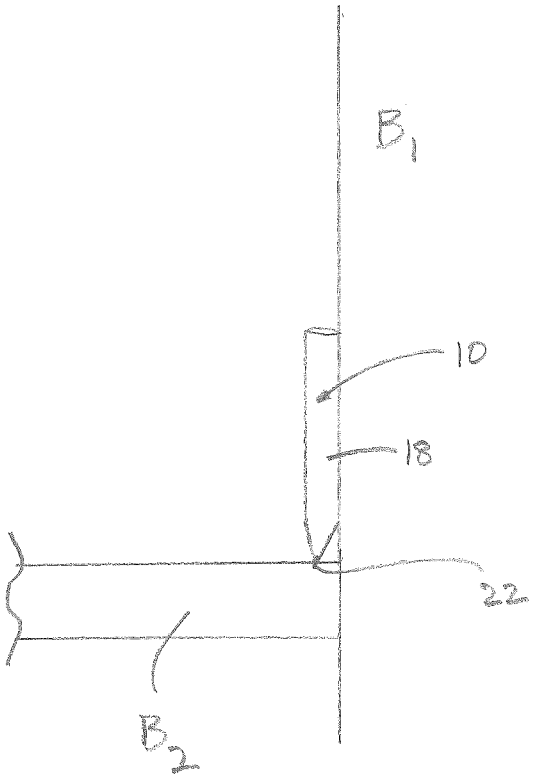
FIG. 10*a* is a side view representation of an embodiment of the writing instrument in use scribing a second building material.
Figure 10B:
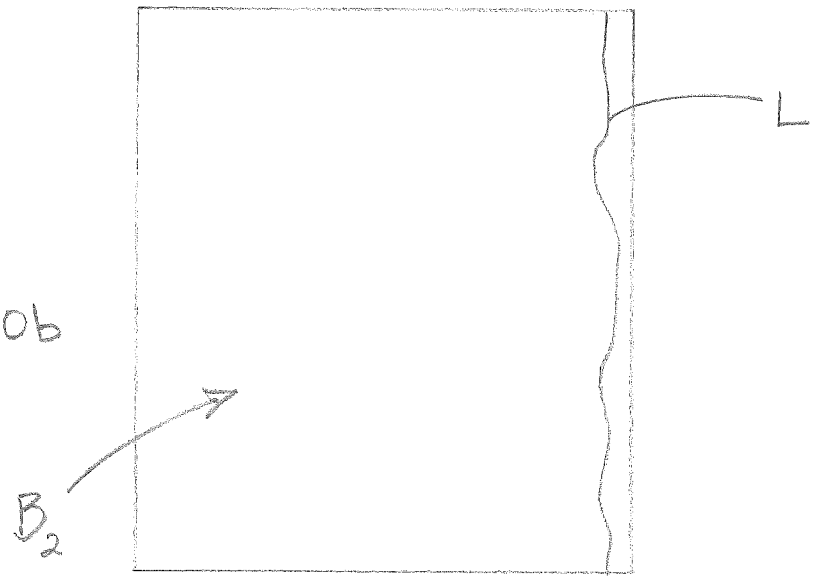
FIG. 10*b* is a top view of the second building material showing the scribed line marked by the writing instrument in FIG. 10*b*.

FIGS. 10*a* and 10*b* show a representation of the writing instrument 10 in use to scribe a cut line L on a second building material $B_2$ (i.e., a board). As can be seen in the side view of FIG. 10*a*, the writing instrument 10 is held with the side surface of its body 18 flat against the first building material $B_1$ (i.e., a wall) and moved across the length of the board $B_2$ to mark the line L that is commensurate to the contour of the wall $B_1$ surface. FIG. 10*b* shows a top view of the board $B_2$ with the marked scribe line L that substantially matches the surface contour of the first building material $B_1$.

It should be noted that the specific dimensions and materials identified herein with respect to the writing instrument 10 are for illustrative purposes only. For example, embodiments exist with different radii of curvature of the cross section of the pencil, different distances between respective edges or other elements like the marking tip. For example, as noted above, the inventive concepts of the writing instrument 10 are not limited to strictly being a "pencil" in its conventional meaning with a graphite rod surrounded by wood material, although such is the most common instrument used in carpentry and indeed the preferred embodiment. Embodiments exist that include an ink or marker tip with another inert material forming the body, such as plastic.

The uneven outer ovular (egg-shaped) cross-sectional contour of the writing instrument 10 and the relative positioning of the tip 22 to the edges (i.e., not central) allows considerable variability in clearance from the uneven surface of the first building material sufficient to effectively scribe second building materials without use of a separate tool like a compass. The pencil 10 can be used to scribe a variety of building surfaces, including without limitation, walls, floors and ceilings. Accordingly, various modifications, adaptations and alternatives may occur to one skilled in the art without departing from the spirit of the invention and scope of the coverage.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. A writing instrument, comprising:

an elongate body extending in an axial direction from a proximal end to a distal end, the body including an outer circumferential wall having a cross-sectional shape defining a length L in a first direction between opposite edges that therebetween define the longest extent of the cross-section and a width W in a second direction perpendicular to the first direction; and a marking tip at the distal end at a position offset from a center point of at least one of the length L and the width W, wherein the length L and width W are constant along the circumferential wall in the axial direction.

2. The writing instrument of claim 1, wherein the marking tip is offset from the center point of the length L with a first length distance from the marking tip along the length to a first edge of the body $L_1$ and a second length distance from the marking tip along the length to an opposite second edge of the body $L_2$, wherein the ratio of $L_1$ to $L_2$ is at least 1.5:1.

3. The writing instrument of claim 2, wherein the ratio of $L_1$ to $L_2$ is between approximately 1.5:1 and approximately 8:1.

4. The writing instrument of claim 2, wherein the ratio of $L_1$ to $L_2$ is between approximately 2:1 and approximately 6:1.

5. The writing instrument of claim 2, wherein the ratio of $L_1$ to $L_2$ is between approximately 3.5:1 to approximately 4.5:1.

6. The writing instrument of claim 2, wherein the marking tip is offset from the center point of the length L with a first length distance from the marking tip along the length to a first edge of the body $L_1$ and a second length distance from the marking tip along the length to an opposite second edge of the body $L_2$, and a first width distance from the marking tip along the width to a third edge $W_1$ and a second width distance from the marking tip along the width to fourth edge $W_2$, wherein $L_1$ is not equal to $L_2$ and not equal to one or more of $W_1$ and $W_2$.

7. The writing instrument of claim 6, wherein $W_1$ and $W_2$ are approximately equal.

8. The writing instrument of claim 6, wherein $L_1$ is greater than each of $W_1$ and $L_2$, and $L_2$ is less than $W_1$.

9. The writing instrument of claim 8, wherein the ratio of $L_1$ to $W_1$ is between 1.5:1 and 3:1, and the ratio of $L_1$ to $L_2$ is between 2:1 and 6:1.

10. The writing instrument of claim 9, wherein $L_1$ is between approximately 0.25 inches and approximately 0.75 inches.

11. The writing instrument of claim 10, wherein $L_1$ is approximately 0.5 inches and $L_2$ is approximately 0.125 inches, and $W_1$ and $W_2$ are approximately 0.25 inches.

12. The writing instrument of claim 1, wherein the cross-sectional shape is egg-shaped.

13. The writing instrument of claim 1, wherein the cross-sectional shape includes two substantially symmetrical halves across an axially extending plane.

14. The writing instrument of claim 1, wherein the marking tip extends axially through the distal end of the body.

15. The writing instrument of claim 14, wherein the marking tip is the distal end of a linear rod.

16. A writing instrument, comprising:

an elongate body extending in an axial direction from a proximal end to a distal end, the body including an outer circumferential wall having a non-uniform cross-section in a direction perpendicular to the axial direction, the cross-section having a width W and a length L that is not equal to the width W; and a marking tip at the distal end of the body extending linearly through the distal end of the body in the axial direction, wherein the marking tip is offset from a midpoint along at least one of the width W and length L, and the length L and width W are constant along the circumferential wall in the axial direction.

17. The writing instrument of claim 16, wherein the cross-section of the body is substantially egg-shaped.

18. The writing instrument of claim 16, wherein the length L is along a mid-line between two symmetrical half portions of the cross-section and the marking tip is offset from the midpoint along the length L.

19. A writing instrument, comprising:

an elongate body extending in an axial direction from a proximal end to a distal end, the body including an outer circumferential wall having a substantially round cross-sectional shape; and a marking tip at the distal end of the body extending linearly through the distal end in the axial direction, wherein the marking tip is at a position offset from a center of the round cross-sectional shape, and the cross-sectional shape is constant along the circumferential wall in the axial direction.

20. The writing instrument of claim 19, wherein the cross-section is substantially ovular defining a length L and a width W that is less than the length L, wherein the marking tip is offset from the center of the length L.

* * * * *